US010428579B2

(12) United States Patent
Brioschi

(10) Patent No.: US 10,428,579 B2
(45) Date of Patent: Oct. 1, 2019

(54) DEVICE FOR STOPPING, RELEASING AND RESTORING THE POSITION OF ROLLER-TYPE WINDOW NETS

(71) Applicant: FANDIS S.P.A., Milan (IT)

(72) Inventor: Roberto Brioschi, Borgoticino (IT)

( * ) Notice: Subject to any disclaimer, the term of this patent is extended or adjusted under 35 U.S.C. 154(b) by 0 days.

(21) Appl. No.: 15/324,220

(22) PCT Filed: Jul. 8, 2014

(86) PCT No.: PCT/IT2014/000181
§ 371 (c)(1),
(2) Date: Jan. 5, 2017

(87) PCT Pub. No.: WO2016/006005
PCT Pub. Date: Jan. 14, 2016

(65) Prior Publication Data
US 2017/0167190 A1 Jun. 15, 2017

(51) Int. Cl.
*E06B 9/60* (2006.01)
*E06B 9/42* (2006.01)
(Continued)

(52) U.S. Cl.
CPC ..... *E06B 9/60* (2013.01); *E06B 9/42* (2013.01); *E06B 9/44* (2013.01); *E06B 9/50* (2013.01);
(Continued)

(58) Field of Classification Search
CPC ..... E06B 9/60; E06B 9/42; E06B 9/54; E06B 9/78; E06B 9/80; E06B 2009/804; E06B 9/50
See application file for complete search history.

(56) References Cited

U.S. PATENT DOCUMENTS 5,263,527 A * 11/1993 Marlatt ..... A62C 2/242 160/310
6,158,563 A * 12/2000 Welfonder ..... E06B 9/90 160/291
(Continued)

FOREIGN PATENT DOCUMENTS

KR 101359513 B1 * 2/2014 ..... E06B 9/262

OTHER PUBLICATIONS

International Search Report and Written Opinion—PCT/IT2014/000181—ISA/EPO—dated Feb. 25, 2015.
(Continued)

*Primary Examiner* — Katherine W Mitchell
*Assistant Examiner* — Jeremy C Ramsey
(74) *Attorney, Agent, or Firm* — Seyfarth Shaw LLP

(57) ABSTRACT

A device (1) is described for stopping, releasing and restoring the position of roller-type window nets (3, 48), comprising: a fixing shaft (13) having a coupling groove (15) formed in a front external circumferential surface thereof and an insertion groove (16) formed in a rear surface thereof; a ball rotor (18) inserted into the fixing shaft (13) and coupled to the external circumferential surface of the fixing shaft (13), including a front portion coupled by means of a spring (30) and having a conveying groove (20) formed in a surface thereof for conveying a ball (40) and a guide jaw (38) formed in a central part thereof, wherein the ball (40) is inserted into the conveying groove (20); and an outer rotor (42) coupled to the conveying groove (20) via the ball (40) and having a rotation groove (44) formed in an internal circumferential surface thereof, wherein the ball (40) is coupled to the rotation groove (44) to rotate.

4 Claims, 3 Drawing Sheets

(51) Int. Cl.

| | |
|---|---|
| ***E06B 9/50*** | (2006.01) |
| ***E06B 9/44*** | (2006.01) |
| ***E06B 9/54*** | (2006.01) |
| ***E06B 9/78*** | (2006.01) |
| ***E06B 9/80*** | (2006.01) |

(52) U.S. Cl.
CPC ..... *E06B 9/54* (2013.01); *E06B 9/78* (2013.01); *E06B 9/80* (2013.01); *E06B 2009/543* (2013.01); *E06B 2009/785* (2013.01); *E06B 2009/802* (2013.01)

(56) References Cited

U.S. PATENT DOCUMENTS

| | | | | |
|---|---|---|---|---|
| 8,356,653 | B2 * | 1/2013 | Fu-Lai | E06B 9/322 160/170 |
| 8,746,320 | B2 * | 6/2014 | Yu | E06B 9/322 160/170 |
| 2002/0048083 | A1 | 4/2002 | Okumura | |
| 2012/0266413 | A1 * | 10/2012 | Kao | E06B 9/42 16/96 D |
| 2012/0298318 | A1 | 11/2012 | Wolek | |
| 2013/0037225 | A1 | 2/2013 | Huang | |
| 2014/0352898 | A1 * | 12/2014 | Veatch | E06B 9/17 160/323.1 |
| 2015/0368966 | A1 * | 12/2015 | Faller | E06B 9/80 160/311 |

OTHER PUBLICATIONS

International Preliminary Report on Patentability—PCT/IT2014/000181—ISA/EPO—dated Oct. 1, 2017.

* cited by examiner

DEVICE FOR STOPPING, RELEASING AND RESTORING THE POSITION OF ROLLER-TYPE WINDOW NETS

The present invention relates to a device for stopping, releasing and restoring the position of roller-type window nets (for example curtains or mosquito nets), and more particularly, to a device for stopping, releasing and restoring the position of roller-type window nets capable of opening and closing a wire mesh in an easy and simply manner, being very conveniently used since any user can open the wire mesh in simple handling operations and completely solving the problem regarding inclination of the wire mesh whose both ends roll up while leaning to one side.

As shown in FIG. 1, a body of a conventional window net 103 includes an elastic recovery roll unit 109 configured to windingly store the window net 103, a guide rail 107 configured to guide both lateral ends of the window net 103 installed at both sides of the recovery roll unit 109 to extend therefrom, a handle frame 105 formed at a lower end of the window net 103, and a lower closing bar 115 installed at both sides of the guide rail 107.

The window net 103 is closed by grabbing the handle frame 105 and pulling down the handle frame 105. In this case, a central part or both lateral parts of the handle frame 105 have to be pressed exactly so that the window net 103 can be fixed in its operating, covering position.

Also, only when the central part or both lateral parts of the handle frame 105 are pressed exactly upon opening of the window net 103, the window net 103 is opened while rolling up both sides of the window net 103 at the same time.

However, such a conventional window net 103 has problems in that the central part or both lateral parts of the handle frame 105 should be pressed exactly to open the window net 103, and that the window net 103 may roll up in an inclined or crooked state when the handle frame 105 is pressed at wrong positions, which results in malfunction or breakdown of the window net 103.

As described above, the children and elderly experience much inconvenience from this, since the window net 3 has to be carefully opened.

Accordingly, the present invention is designed to solve the problems of the prior art, and therefore it is an object of the present invention to provide a device for stopping, releasing and restoring the position of roller-type window nets capable of easily opening/closing a wire mesh since the wire mesh can be opened and closed by rotation of a rotor having a ball coupled thereto rather than a method of coupling a switchgear system to hanging protrusions or fixing hooks, and significantly cutting the installation and production cost due to a simple structure.

It is another object of the present invention to provide a device for stopping, releasing and restoring the position of roller-type window nets capable of being used very conveniently since a wire mesh is opened while rolling up without any inclination when any part of a handle is touched once by a user.

To solve the above problem of the prior art, according to an aspect of the present invention, there is provided a device for stopping, releasing and restoring the position of roller-type window nets according to claim 1. Preferred embodiments and non-trivial variations of the present invention are the subject matter of the dependent claims.

It is intended that the attached claims form an integral part of the present description.

The above and other objects, features and advantages of the present invention will become more apparent to those of ordinary skill in the art by describing in detail exemplary embodiments thereof with reference to the accompanying drawings, in which.

Hereinafter, exemplary embodiments of the present invention will be described in detail. However, the present invention is not limited to the embodiments disclosed below, but can be implemented in various forms. The following embodiments are described in order to enable those of ordinary skill in the art to embody and practice the present invention.

With reference to the appended drawings, exemplary embodiments of the present invention will be described in detail below. To aid in understanding the present invention, like numbers refer to like elements throughout the description of the figures, and the description of the same elements will be not reiterated.

Figure 1:
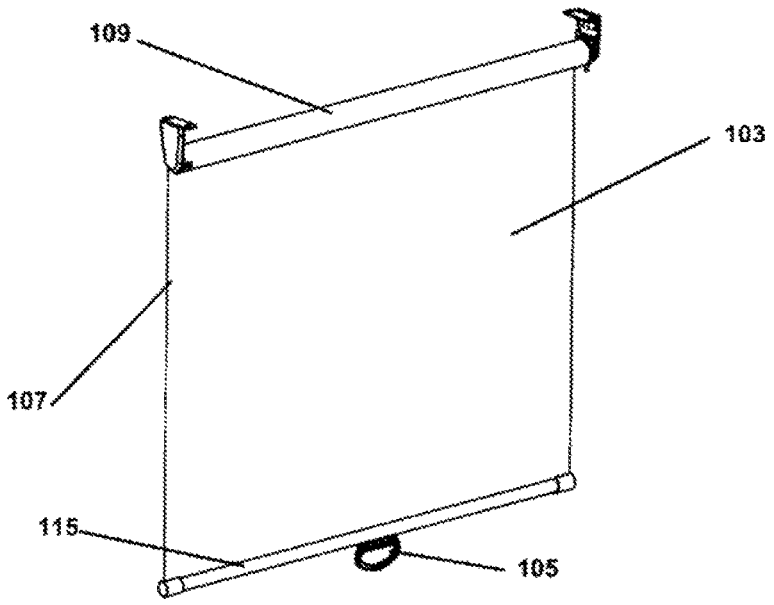
FIG. 1 (PRIOR ART)
FIG. 1 is a perspective view showing a configuration of a prior-art window net.
Figure 2:
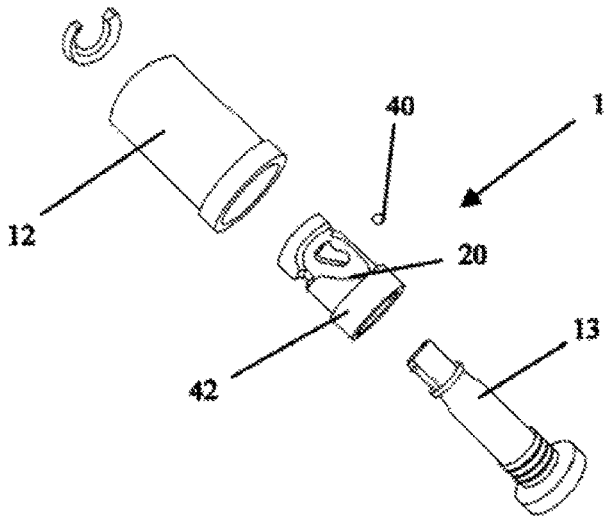
FIG. 2 is an exploded perspective view of a preferred embodiment of the device according to the present invention.
Figure 3:
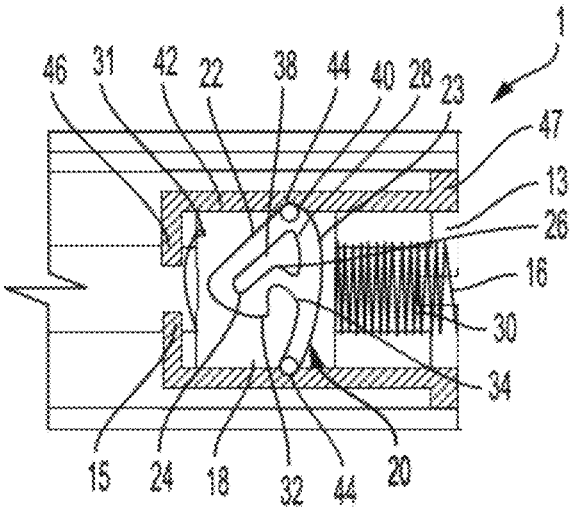
FIG. 3 is a cross-sectional view of the device of FIG. 2 in its assembled condition.
Figure 4:
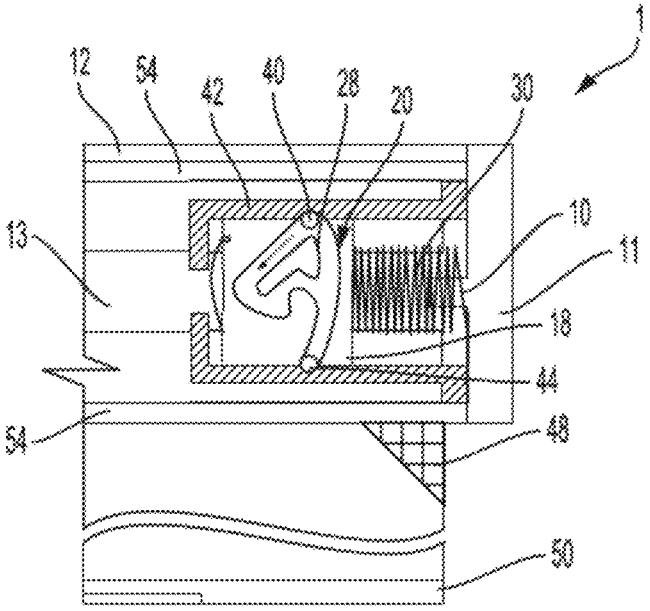
FIG. 4 is a cross-sectional view of the device of FIG. 3 in a first operating position.
Figure 6:
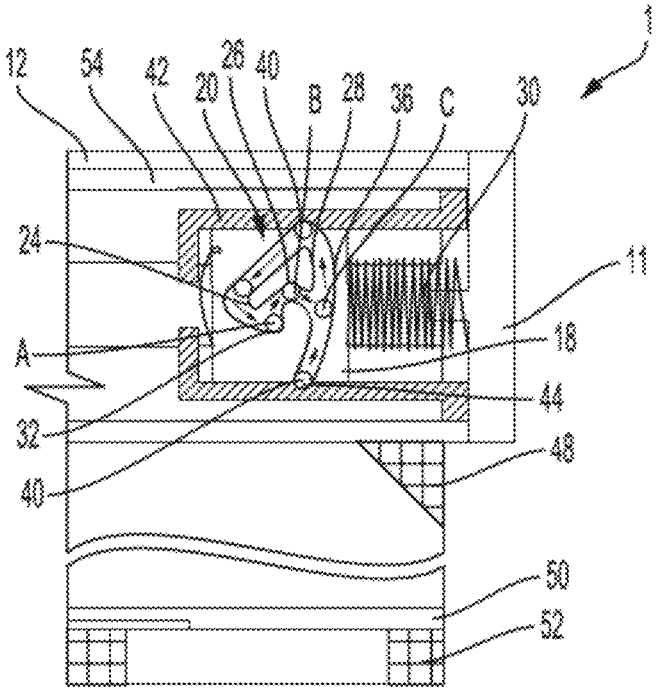
FIG. 6 is a cross-sectional view of the device of FIG. 3 in a third operating position.

FIGS. 3, 4 and 6 show the entire configuration of a device 1 according to the present invention.

The device 1 includes a fixing shaft 13 having a coupling groove 15 formed in a front surface thereof and an insertion groove 16 formed in a rear surface thereof, a ball rotor 18 including a front portion coupled by means of a spring 30 and having a conveying groove 20 formed therein for conveying a ball 40 and a guide jaw 38 formed in a central part thereof, and an outer rotor 42 having a rotation groove 44 formed in an internal circumferential surface thereof.

The fixing shaft 13 has the coupling groove 15 formed in an external circumferential surface of one front side thereof and the insertion groove 16 formed in a rear central surface thereof. A fixing hole 10 of a housing 12 is coupled to the insertion groove 16 to support the fixing shaft 13 in order to prevent rotation of the fixing shaft 13.

Also, one lateral end of the spring 30 is fixed in the external circumferential surface of the front side of the fixing shaft 13, and the other lateral end of the spring 30 is fixed in one front side of the ball rotor 18 that will be described later by means of a screw 31.

The conveying groove 20 is formed in an external circumferential surface of the ball rotor 18 so that the ball 40 is coupled to the conveying groove 20 to rotate the conveying groove 20 in a vertical direction, and a hollow portion 23 is formed in a central part of the ball rotor 18 so that the fixing shaft 13 is inserted through the hollow portion 23. The conveying groove 20 is formed in a U shape so that a surface of the conveying groove 20 curves inwards in the middle, and the external diameter of the ball 40 is inserted into the conveying groove 20, and coupled to the conveying groove 20.

Further, in the shape of the conveying groove 20, an inclination groove 22 inclined downwards is formed in an external circumferential surface of a front side of the conveying groove 20, and a vertical groove 32 is formed in an end portion of the inclination groove 22. Also, an inclination groove 34 inclined in one direction to be directly coupled to the vertical groove 32 is provided, and a longitudinal groove 36 goes past the inclination groove 34 to be formed along a longitudinal direction.

The ball rotor 18 is formed so that a rear longitudinal groove having the same shape as the longitudinal groove 36 formed in front of the inclination groove 34 is coupled to an external circumferential surface of the rear side of the ball rotor 18.

Also, a guide jaw 38 shaped as a hook is formed in the central part of the ball rotor 18 having the conveying groove 20 formed therein, and thus serves to fix the ball 40 coupled to the conveying groove 20 and a rotation groove 44 of the outer rotor 42 to be described later at constant positions.

The guide jaw 38 does not move backwards but moves forwards when a rear jaw 24 is formed longer than the vertical groove 32 formed below the rear jaw 24 so that the ball 40 is positioned in the vertical groove 32. Also, a concave jaw 26 formed in the central part of the guide jaw 38 is formed to protrude to the lesser extent than the inclination groove 34 formed below the concave jaw 26, and thus the ball 40 moves forwards to rotate along the longitudinal groove 36, and then rotates about the longitudinal groove formed in the external circumferential surface of the rear side to return to the vertical groove 32.

In this case, the central point of the upper protrusion 28 formed in an upper portion of the guide jaw 38 is formed aslant to the right with respect to the center of the conveying groove 20 formed on the upper protrusion 28, and thus the rotating ball 40 rotates while moving toward the inclination groove 22, that is, moving to the right, by means of the upper protrusion 28.

The outer rotor 42 has a coupling unit 46 coupled to the coupling groove 15 of the fixing shaft 13 formed at a front side thereof, and a raised protrusion 43 formed at a rear end thereof. Also, a rotation groove 44 having the same diameter as the conveying groove 20 of the ball rotor 18 is formed in the internal circumferential surface of the outer rotor 42. Each of the conveying groove 20 and the rotation groove 44 is coupled to the ball 40 so that the conveying groove 20 and the rotation groove 44 occupy approximately half of the external diameter of the ball 40.

Also, a wire mesh 48 is wound around an outer surface of the outer rotor 42, and the rotation roller 54 having a handle 50 coupled thereto is coupled to an end of the wire mesh 48. Further, known guide rails are formed at both lateral ends of the wire mesh 48 to allow the wire mesh 48 to move up and down.

When the handle 50 formed at an end of the wire mesh 48 is pulled down, the outer rotor 42 coupled to the rotation roller 54 rotates. At the same time, the outer rotor 42 and the ball rotor 18 coupled to each other by means of the ball 40 rotate in the same direction. As described above, the rotation roller 54, the outer rotor 42 and the ball rotor 18 rotate in the same direction at the same time.

Figure 5:
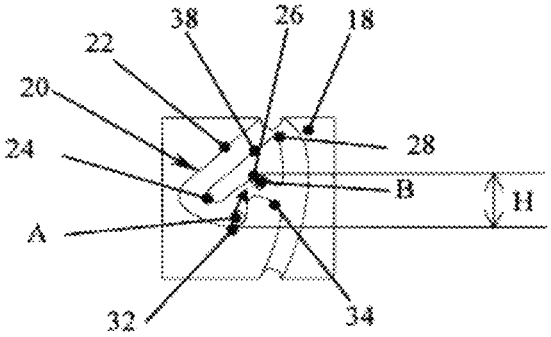
FIG. 5 is a cross-sectional view of part of the device of FIG. 3 in a second operating position.

As shown in FIG. 5, the height H is a distance such that, when the handle 50 of the wire mesh 48 is pulled down to the end, the ball 40 coupled to the rotation groove 44 of the outer rotor 42 and the conveying groove 20 of the ball rotor 18 moves towards the inclination groove 22 by means of the upper protrusion 28 of the guide jaw 38, and then rotates at a point A that is a point of the vertical groove 32.

In this case, the spring 30 coupled to the ball rotor 18 via the screw 31 is wound while rotating together in the same direction, thereby maintaining a narrower distance and a higher friction force.

Also, when the handle 50 is released, the ball 40 goes past the vertical groove 32 to be a standby state in a point B that is a point of the concave jaw 26.

In this case, the spring 30 slightly rotates in a reverse direction while maintaining a strained state, and then in a stopped state. That is, the friction force of the spring 30 remains in a high level.

As shown in FIG. 6, in the thereby-configured device 1 according to the present invention, when a user grabs the handle 50, pulls down the handle 50 to the end, and then releases the handle 50, the ball 40 rotates, the ball 40 being coupled to the conveying groove 20 of the ball rotor 18 and the rotation groove 44 of the outer rotor 42 so that the conveying groove 20 and the rotation groove 44 occupy approximately half of the external diameter of the ball 40, and then the ball 40 rotates by means of the upper protrusion 28 of the guide jaw 38 while moving towards the inclination groove 22. This is because the central part of the upper protrusion 28 is formed further to the right than the central point of the conveying groove 20 formed in an upper portion of the upper protrusion 28, and thus the ball 40 does not move to the right but moves to the left. Also, the ball 40 goes past the inclination groove 22 to be positioned at a point A that is a point of the vertical groove 32.

When a user releases the handle 50, the ball 40 goes past the vertical groove 32, moves to a point B that is a point of the concave jaw 26, and then remains in a standby state. In this case, the spring 30 fixed in the front of the ball rotor 18 by means of the screw 31 is also wound forwards, which results in an increase in friction force.

In this condition, when a user pulls down any region of the handle 50 to open the wire mesh 48, the ball 40 goes past the inclination groove 34 and moves to a point C that is a point of a longitudinal groove 23. At the same time, the wire mesh 48 is opened upwards by means of an elastic force while the strained spring 30 is released.

Further, the ball 40 rotating upwards along the longitudinal groove 36 moves up again while rotating along the rear longitudinal groove formed in the external circumferential surface of the rear side of the ball rotor 18. Then, the upper ball 40 moves to the left, that is, moves along the inclination groove 22, by means of the upper protrusion 28 of the guide jaw 38, and then is in a standby state when the ball 40 is positioned on the vertical groove 32.

As described above, the device for stopping, releasing and restoring the position of roller-type window nets according to the present invention has advantages in that the device exhibits excellent convenience, since it can be easily installed due to a simple structure and any user can open and close a wire mesh easily and conveniently.

Also, the device for stopping, releasing and restoring the position of roller-type window nets according to the present invention has the advantage that it can be handled very conveniently, since the closed wire mesh is opened while rolling up without any inclination when a user pulls down any part of the handle.

The invention claimed is:

1. Device (1) for stopping, releasing and restoring a position of roller window nets (48), the device (1) comprising:

a fixing shaft (13) having a coupling groove (15) formed in a front of an external circumferential surface thereof and an insertion groove (16) formed in a rear surface thereof;

a ball rotor (18) inserted onto the fixing shaft (13) and coupled to the external circumferential surface of the fixing shaft (13), the ball rotor (18) including a front portion coupled by means of a spring (30) and having a conveying groove (20) formed in a surface thereof for conveying a ball (40) and a guide jaw (38) formed in a central part thereof, wherein the ball (40) is inserted into the conveying groove (20), in which the spring (30) comprises a first lateral end releasably fixed in the external circumferential surface of a front side of the fixing shaft (13), and a second lateral end fixed in a front side of the ball rotor (18) by means of a screw (31); and an outer rotor (42) coupled to the conveying groove (20) via the ball (40) and having a rotation groove (44) formed in an internal circumferential surface thereof, wherein the ball (40) is coupled to the rotation groove (44) to rotate;

wherein the first lateral end of the spring (30) is releasably fixed to the external circumferential surface of the front side of the fixing shaft (30); and wherein the second lateral end of the spring (30) is fixed to the front portion of the ball rotor (18) by means of the screw (31) secured to a threaded opening in the front portion of the ball rotor (18) to wind the spring (30) through the front portion of the ball rotor (18).

2. Device (1) according to claim 1, in which the guide jaw (38) has a protrusion (28) configured to induce movement of the ball (40).

3. Device (1) according to claim 1, in which, in a shape of the conveying groove (20), a first inclination groove (22) inclined downwards is formed in an external circumferential surface of a front side of the conveying groove (20), and a vertical groove (32) is formed in an end portion of the first inclination groove (22), a second inclination groove (34) being provided inclined in one direction to be directly coupled to the vertical groove (32), and a longitudinal groove (36) going past the second inclination groove (34) to be formed along a longitudinal direction.

4. Device (1) according to claim 1, in which the guide jaw (38) is shaped as a hook and is adapted to fix the ball (40) coupled to the conveying groove (20) and a rotation groove (44) of the outer rotor (42) at constant positions.

* * * * *